United States Patent [19]

Piëch et al.

[11] 4,100,619

[45] Jul. 18, 1978

[54] PROTECTIVE HELMET

[75] Inventors: Corina Piëch, Gänkopf No. 30, 7000 Stuttgart 1, Fed. Rep. of Germany; Wolfram Schleicher, Stuttgart, Fed. Rep. of Germany

[73] Assignee: Corina Piëch, Stuttgart, Fed. Rep. of Germany

[21] Appl. No.: 762,151

[22] Filed: Jan. 24, 1977

[30] Foreign Application Priority Data

| | | | |
|---|---|---|---|
| Jan. 30, 1976 | [DE] | Fed. Rep. of Germany | 2603490 |
| Mar. 2, 1976 | [DE] | Fed. Rep. of Germany | 2608626 |
| Aug. 23, 1976 | [DE] | Fed. Rep. of Germany | 7626308[U] |

[51] Int. Cl.[2] ..... A61F 9/00

[52] U.S. Cl. ..... 2/10

[58] Field of Search ..... 2/10, 9, 2.5, 8, 6, 2/2.1 R, 2.1 A

[56] References Cited

U.S. PATENT DOCUMENTS

| | | | |
|---|---|---|---|
| 3,162,862 | 12/1964 | Miller | 2/6 |
| 3,239,843 | 3/1966 | Lobelle | 2/6 |
| 3,601,813 | 8/1971 | Aileo | 2/6 |
| 3,906,547 | 9/1975 | Aileo | 2/6 |
| 3,945,043 | 3/1976 | De Angelis | 2/8 |

*Primary Examiner*—Doris L. Troutman

*Attorney, Agent, or Firm*—Lawrence E. Laubscher

[57] ABSTRACT

A protective helmet for use by the riders of motorcycles and the like is disclosed, characterized by the provision of a visor which is pivotally connected with the helmet by pivot means contained solely within the interior of the helmet. In a preferred embodiment, the helmet comprises a shell including separate, superimposed body and cover portions each containing a window opening, the cover portion being connected with and spaced from the body portion to define a space for receiving the visor when the visor is pivoted about a horizontal pivot axis from the closed protective position toward an open position relative to the window opening. In a alternate embodiment, the visor is generally cylindrical and fits within a pair of oppositely disposed guides extending continuously around the horizontal inner circumference of the shell above and below the window opening, respectively, whereby the visor pivots about a vertical pivot axis. In each embodiment, locking devices are provided for locking the visor in a selected one of a plurality of positions relative to the helmet and the window opening therein.

7 Claims, 8 Drawing Figures

Fig. 4
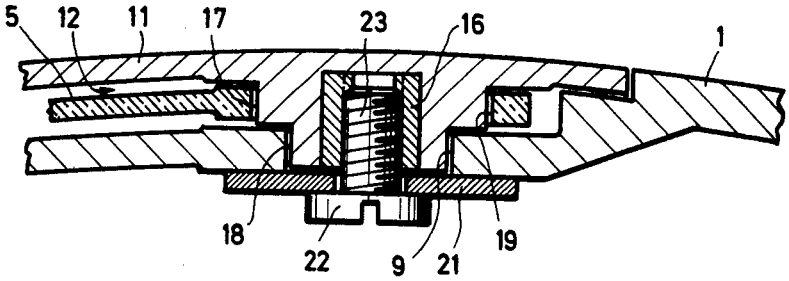
Fig. 5
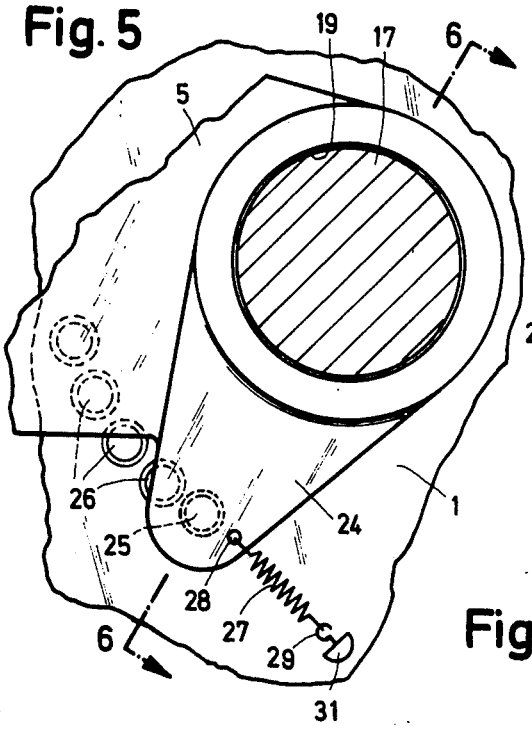
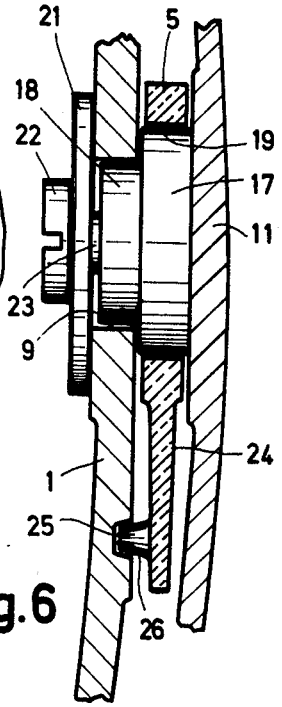
Fig.6

PROTECTIVE HELMET

BACKGROUND AND SUMMARY OF THE INVENTION

This invention relates to a protective helmet, particularly for drivers of motor-driven two-wheeled vehicles, comprising a helmet shell having front and chin parts, a window opening provided therein, and a visor of transparent material movably connected with the helmet shell for closing and opening the window.

In known protective helmets of this kind, the visor is pivotally mounted on the outside of the helmet shell. The visor is ordinarily made of transparent flexible flat material and is curved so as to conform to some extent to the curvature of the helmet. With this arrangement, the closing operation of the visor is complicated and time consuming because in order to provide a seal between the visor and the helmet shell, additional fastening elements, such as press-studs, have to be operated and these are liable to fail and frequently do not function. The latter shortcoming is generally due to the fact that the curved visor becomes distorted. Consequently, it takes some time before the driver, usually a motorcyclist, is ready to ride off. Furthermore, there is no certainty that the visor will remain continuously in the open position, because it tends to drop to its lower closed position spontaneously. Furthermore, even at a moderate road speed, it is dangerous to open the visor because air pressure will build up between the helmet shell and the visor projecting from the latter, so that the helmet will be torn off in the rearward direction. Finally, with known protective helmets of the kind in question, a half-open position of the visor, which is necessary to prevent the visor from fogging up while at the same time providing protection for the eyes, is not possible.

The problem of the invention is therefore remedying the shortcomings mentioned above and providing a protective helmet having a visor which is reliably guided, does not give rise to air pressure when opened, and can be operated easily and rapidly, while at the same time providing good sealing in the closed position.

According to the invention, this problem is solved by pivotally mounting the visor inside the helmet shell so that at least when in the open position, the visor is partly covered by parts of the helmet shell both on the inside and on the outside.

BRIEF DESCRIPTION OF THE FIGURES

Further features and advantages of the invention will become apparent from the description given below of preferred embodiments, the conjunction with the accompanying drawing, in which:

FIG. 4 is a partial sectional view of the helmet in a substantially horizontal plane;

FIG. 5 is a partial sectional view of the helmet;

FIG. 6 is a partial sectional view on the line 6—6 in FIG. 5;

DETAILED DESCRIPTION

Figure 1:
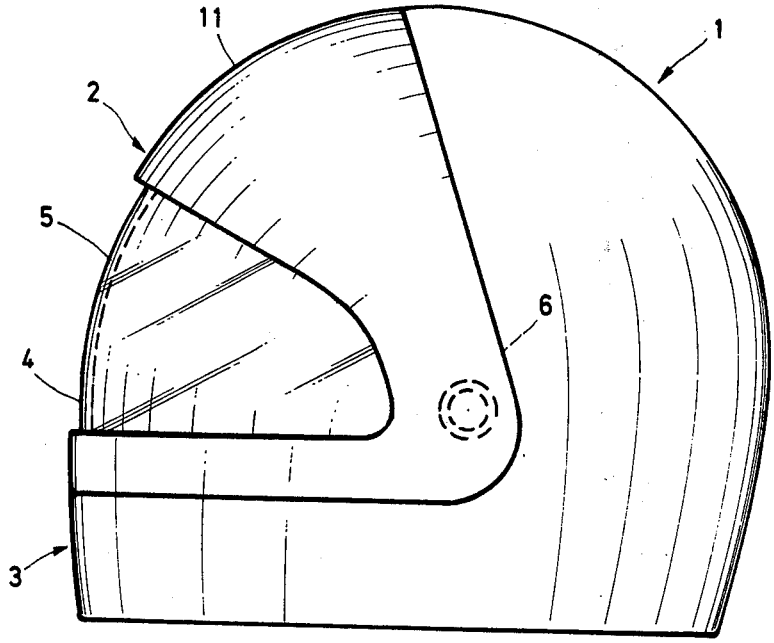
FIG. 1 is a side view of the protective helmet.

As shown in FIG. 1, the helmet shell 1 of a protective or crash helmet comprises a front part 2 and a chin part 3. Between these parts a window opening 4 is provided giving the widest possible field of vision in the region of the eyes of a person wearing the helmet. The window 4 can be closed by a visor 5 which is made of transparent material. The visor is mounted on the helmet by a rotary mounting 6 so that the visor is pivotal inside the helmet shell 1 about a substantially horizontal axis from the closed position shown in FIG. 1 to an open position in which it lies in the region of the front part 2.

Figure 2:
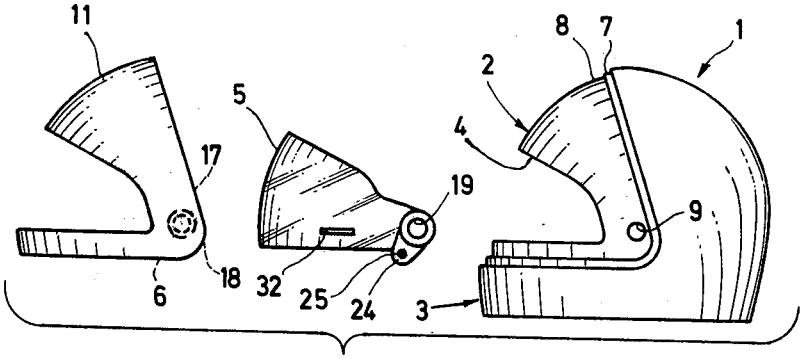
FIG. 2 shows the three essential components of the helmet of FIG. 1 in the dismantled state.

As can be seen from FIG. 2, the helmet shell 1 is provided at a certain distance from the window 4 with two steps 7 and 8, offset in the direction of the interior of the helmet, the step 8 continuing into the front part 2 of the helmet. The two parts 2 and 3 are integrally joined together and are preferably made of impact and shock-resistant material such as a plastics material having the lowest possible specific gravity. In the stepped portion of the helmet shell 1, an opening 9 is provided which is part of the rotary mounting 6. As shown in FIG. 2, a cover 11 can be mounted on the step 7 so as to merge smoothly to the remainder of the helmet shell. The cover 11 may be joined to the helmet shell 1 with the aid of the rotary mounting 6 which will be described below. For the purpose of sealing the cover 11 and the remainder of the helmet shell 1, sealing material may be applied to the step 7. The cover 11 is also preferably formed of a suitable synthetic plastic material of the lowest possible specific gravity. It is preferably of a different color from the remainder of the helmet shell, as indicated by corresponding hatching in FIG. 1. The cover 11 may, however, be made relatively thin, since the thickness of the actual helmet shell 1 (shown on the right in FIG. 2) is already such that it is sufficiently impact-and shock-resistant and protects the head of the wearer against injury in the event of a fall, even without the cover 11. The cover 11 and also the part of the helmet shell 1 lying beneath it are spherical in shape.

When the cover 11 is mounted on the step 7, a hollow gap 12 (FIG. 3) is formed between the cover 11 and the surface of the step 8. The visor 5, which may be inserted before the cover 11 is fitted, may be pushed into the upper part of this gap 12 in such a manner as to be covered, and thus protected both on its inner and outer sides by the helmet shell 1 or the cover 11. It is therefore impossible for air pressure to be built up between the open visor 5 and the helmet shell. The visor 5 made of transparent synthetic plastic material is also spherical in shape, so that it can be introduced into the spherical gap 12 without obstruction.

Figure 3:
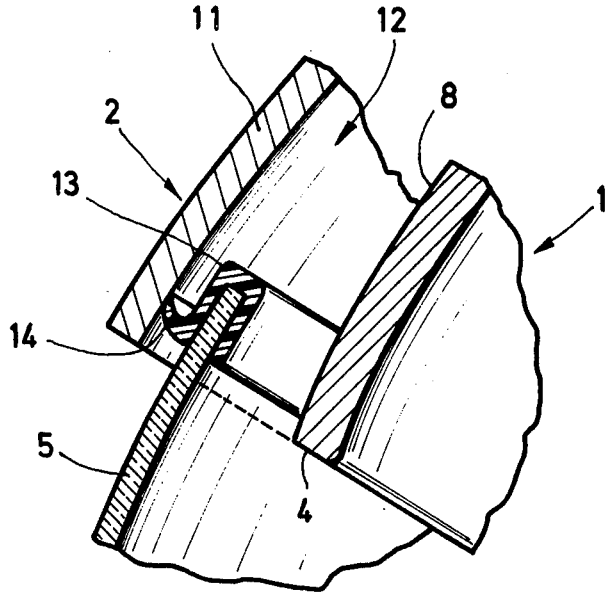
FIG. 3 is a partial sectional view of the helmet in the vertical plane.
Figure 3:
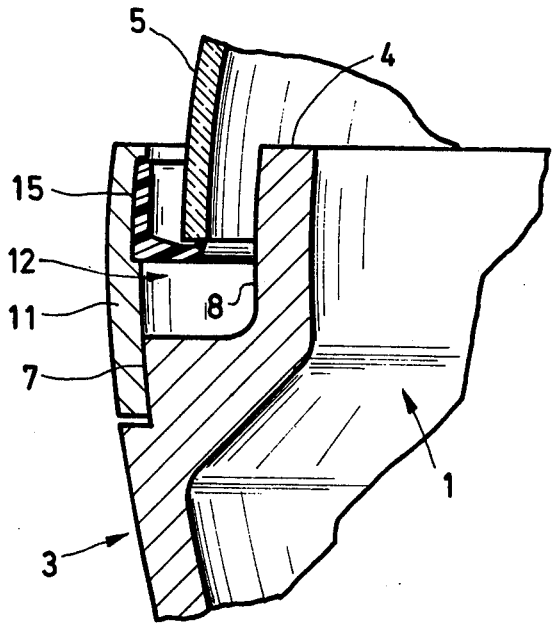

As shown in FIG. 3, a sealing strip 13 of soft elastic material, such as rubber, is fastened on the upper edge of the visor 5. The sealing strip 13 has at least one lip 14 which lies against the inside of the cover 11 at least when the visor 5 is closed. The arrangement of the sealing strip 13 on the visor 5 instead of on the cover 11 is advantageous because scratching of the visor 5 during opening and closing is avoided. The bottom edge of the visor 5 is sealed in the closed state by a sealing strip 15, in which in the region of the bottom edge of the window opening 4 is fastened on the inside of the cover 11. The arrangement of the sealing strip 15 on the cover 11 rather than on the visor 5 is advantageous because a sealing strip disposed on the bottom edge of the visor would impair the free vision of the wearer of the helmet when the visor is in the half-open position. The construction of the steps 7 and 8 in the bottom region of the helmet shell 1 are also clearly shown in FIG. 3.

The rotary mounting of the visor 5 is illustrated in FIGS. 4, 5, and 6. As shown in FIG. 4, a threaded bush 16 which may be made of metal, is firmly inserted into a thickened portion of the cover 11. The thickened portion of the cover 11 (see also FIG. 6) includes two circular cylindrical steps 17 and 18. The visor 5, which has a circular opening 19 for receiving the thickened portion of the cover 11, is rotatable on the step 17. The step 18 penetrates the previously mentioned opening 9 (FIG. 2) in the helmet shell 1. The opening 9 is covered by a washer 21, which in turn is held in place by the head 22 of a screw 23 which is screwed into the bush 16. In this manner, a firm connection between the helmet shell, the rotary mounting of the visor 5, and the cover 11 is effected. The height of the step 17 is such that the visor can easily be turned between the cover 11 and the helmet shell 1.

As can be seen from FIGS. 2, 5, and 6, there is provided on at least one side of the visor 5 a downwardly projecting beak 24 on which a pin 25 projects inwardly toward the helmet shell 1. On the inside of the helmet shell 1 there are provided on an arc concentric to the axis of rotation of the visor 5 a number of relatively shallow depressions 26 in which the pin 25 may engage. The walls of the conical pin 25 and of the depression 26 are slightly inclined and adjusted to one another in such a manner that when a suitable force is applied, the pin 25 will pass out of one depression 26 and snap into the next because of the elasticity of the material from which the visor 5 and the beak 24 are made. In this manner the depressions 26 in cooperation with the pin 25 provide fixed positions which enable the visor 5 to be adjusted to intermediate positions, such as a half-open position. In the half-open position the eyes of the wearer of the helmet are still covered by the visor, but the lower region of the window 4 is open, so that air can enter there and prevent the inside of the visor form fogging.

As diagrammatically illustrated in FIG. 5, the visor 5 may be loaded by a spring 27, which preferably acts on the beak 24, and which biases the visor 5 toward the closed position. In the diagrammatical representation in FIG. 5, the spring 27 is in the form of a coil spring, one end of which is hooked through a hole 28 in the beak 24 and the other end of which is in a hook 29 which is fastened on a small bracket 31 on the inside of the helmet shell 1. In practice, the spring loading of the visor 5, can be achieved in numerous ways. For example, a spirally wound torsion spring could also act on the visor 5, this spring acting at one end on the visor 5 and at the other end on the helmet shell 1 or cover 11 and being disposed concentrically to the thickened portion consisting of the steps 17 and 18.

As can be seen from the drawing, the rotary mounting 6 of the visor 5 cannot be seen from the exterior of the helmet. In addition, no sealing problems are entailed by it. The pin 25 and the depressions 26 associated with it could also be hemispherical in shape, which would facilitate the movement of the visor 5 and its fastening in position. As can be seen from FIG. 2. in the region of the bottom edge of the visor 5 there is disposed an outwardly projecting gripping strip 32 which may be used by the wearer of the helmet, even when wearing gloves, when he desires to adjust the visor. In the open position of the visor 5, this gripping strip 32 lies at or near the upper edge of the window 4. The gripping strip 32 may also serve as a stop for the visor against the upper edge of the window in order to prevent the visor from completely penetrating into the gap 12 between the helmet shell 1 and the cover 11. A slot 33 in the screwhead 22 (FIGS. 4 and 6) is preferably made wide enough to receive a coin. In this manner, the wearer of the helmet can fit or remove the visor 5, or if desired fit a new cover 11 on the helmet shell 1, without requiring a special tool. The pin 25 and the matching depressions 26 may be used in combination with the spring 27 if desired.

Figure 7:
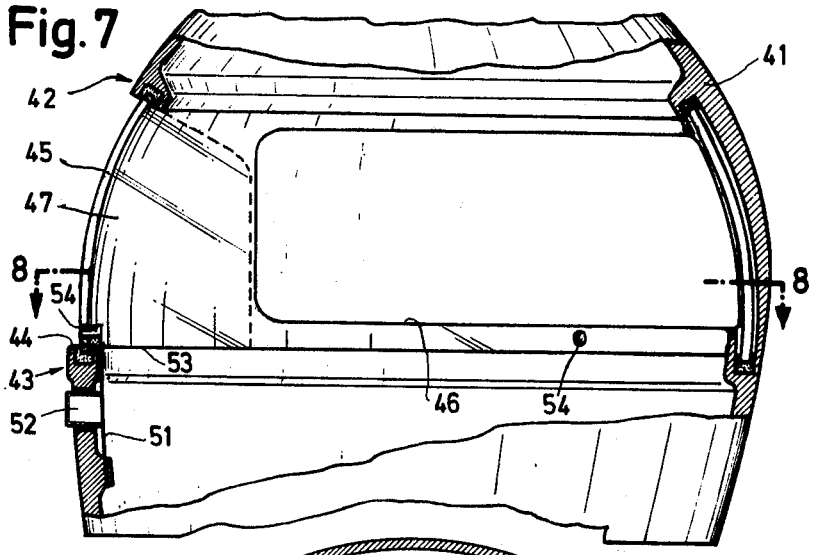
FIG. 7 shows another form of construction of a protective helmet.
Figure 8:
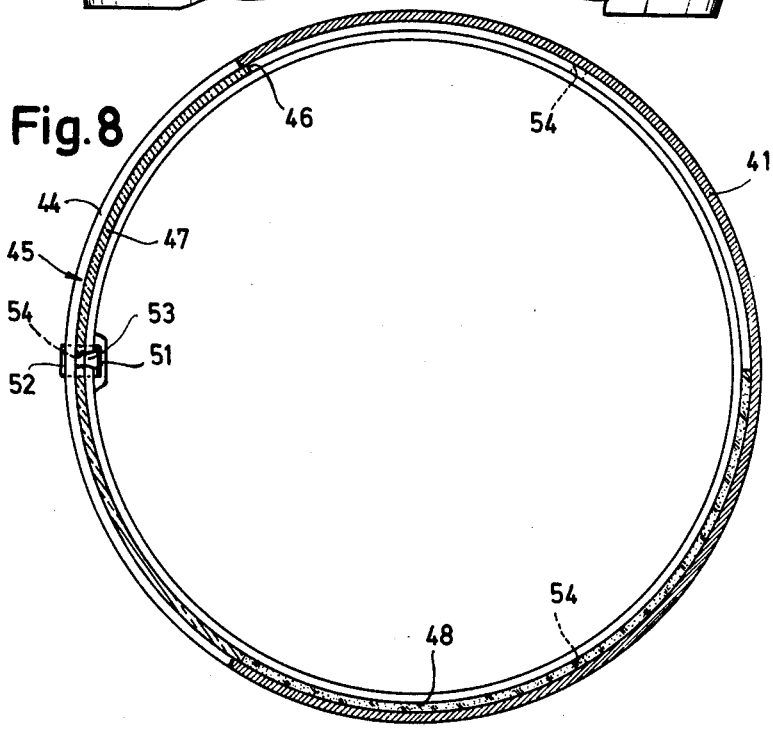
FIG. 8 is a sectional view on the line 8—8 in FIG. 7.

Instead of fastening the visor 5 pivotally as illustrated in FIGS. 1 to 6, it could also be guided in a suitable sliding guide permitting movement between the open and closed positions. A sliding guide of this kind will basically permit movement of the visor from top to bottom and from bottom to top. FIGS. 7 and 8 show another preferred embodiment of the invention comprising a visor disposed in a sliding guide wherein the visor is rotatable not about a horizontal axis as in the previous embodiment but about a substantially vertical axis of the helmet.

In the embodiment shown in FIGS. 7 and 8, the visor 45 is in the form of a cylindrical ring, which is rotatable in the interior of a helmet shell 41 in a sliding guide which at the same time serves to seal the top and bottom edges of the visor. The sliding guide consists of grooves 42, 43 whose walls partly cover the visor 45 on the inside and outside. The annular visor 45 contains an opening 46 which may be made to coincide with the window 44 when the visor is rotated to an open position. For the purpose of closing the visor 45, an unperforated but transparent portion of the ring is brought in front of the window 44. In addition to the opening 46 the annular visor 45 may also have a clear transparent region 47 and a colored transparent region 48 which may be rotated in front of the window 44. The visor ring may slide on seals in the sliding guides 42, 43 but need not necessarily be a complete ring. A ring segment extending only over an angular region between about 180° and 270° may be sufficient.

FIGS. 7 and 8 also show a simple locking or fastening device for the visor 45 in the helmet shell. This device comprises a leaf spring 51 which is fastened at one end to the helmet shell and near its center carries a button 52 which projects outwardly through a corresponding opening in the helmet shell. At its other end the leaf spring 51 carries a tongue 53 which engages in corresponding holes 54 in the visor 45. Such holes 54 are provided in each of the regions 46, 47, and 48 of the visor 45 (see FIG. 8). The spring 51 is prestressed in such a manner that the tongue 53 is normally pressed into the opening 54. When it is desired to move the visor 45, the button 52 is depressed so that the tongue 53 passes out of the opening 54 and the visor can then be moved. When the visor 45 is turned further, the tongue 53 will finally engage in the next aperture 54.

The locking or fastening device described in connection with the embodiment shown in FIGS. 7 and 8 could also be directly applied to the helmet shown in FIGS. 1 and 6, preferably in the region of the bottom edge of the window 4. In this case, before the visor 5 is pivoted upwardly, the button 52 would have to be operated and the tongue 53 brought out of the ocrresponding opening in the visor 5. If the visor 5 is additionally urged towards its open position by a spring, the visor 5 would automatically move upwardly upon depression of the button 52 and pass either to the fully open position or to an intermediate position determined by the pin 25 and a corresponding complementary depression 26.

While in accordance with the Patent Statutes, the preferred form and embodiments of the invention have been illustrated and described, it will be apparent to those skilled in the art that other changes and modifications may be made without deviating from the inventive concepts set forth above.

What is claimed is:

1. A protective helemt, comprising (a) a hollow generally hemi-spherical helmet shell member (41) open at its bottom end and including a front portion containing a viewing window opening (44);

(b) an annular transparent visor member (45) arranged concentrically within said shell member opposite said window opening, said visor member being arranged with its axis extending vertically, said visor member having a diameter corresponding generally with the horizontal diameter of said shell member and containing a window opening; and (c) means (42, 43) connecting said visor member with said shell member for rotation about its vertical axis, said visor member being rotatable between an open position in which said visor window opening and said helmet shell window opening are in alignment, and a closed position in which the transparent portion of said visor member is opposite said helmet shell window opening.

2. A protective helmet as defined in claim 1, wherein said pivot means include a pair of oppositely disposed circular horizontal guides extending continuously around the inner circumference of said shell member, one of said guides being above said window opening for receiving the upper edge of said visor and the other of said guides being below said window opening for receiving the lower edge of said visor, whereby said visor may be pivoted about the vertical axis of said helmet.

3. Protective helmet means, comprising (a) a hollow generally hemi-spherical helmet shell member open at its bottom and including a front portion containing a first recess (7), the bottom wall of said first recess containing a second recess, the lower portion of the bottom wall of said second recess containing a viewing opening, the vertical dimensions of said first and second recesses being appreciably greater than the vertical dimension of said viewing opening;

(b) a cover member having dimensions which correspond with those of said first recess, said cover member being seated in said first recess in spaced relation to the bottom wall of said second recess, said cover member containing an opening in alignment with said shell viewing opening;

(c) means connecting said cover member with said shell member; and (d) a transparent visor member horizontally arranged in said second recess in the space between said cover member and the bottom wall of said second recess, the vertical dimension of said visor member being less than the corresponding dimension of said second recess and such as to permit vertical displacement of said visor member from a closed lower position opposite said openings to an open upper position displaced from said openings.

4. A protective helmet as defined in claim 3, wherein said cover member connecting means comprises a pair of generally diametrically arranged horizontal shaft means at opposite ends of said cover member, respectively, said shaft means extending inwardly within corresponding openings contained in said shell member, and further wherein said visor member is generally U-shaped, the ends of said visor member being mounted for pivotal movement on said shaft means, respectively.

5. A protective helmet as defined in claim 4, and further including visor position locking means for securing said visor member in one of a plurality of positions intermediate its open and closed positions.

6. A protective helmet as defined in claim 5, wherein said visor position locking means comprises a pin (25; 53) on one said members, and a plurality of recesses (26; 54) contained in the other one of said members for selectively receiving said pin and corresponding to different visor positions, respectively.

7. A protective helmet as defined in claim 4, wherein each of said shaft means includes (1) a pair of coaxial cylindrical step portions of decreasing diameter relative to the inner surface of said cover portion, said visor member containing a pair of apertures for receiving the step portions having the larger diameter, respectively, said body portion openings receiving the steps of smaller diameter, respectively;

(2) an internally threaded bush member mounted within a corresponding base contained in the free end of each of said shaft means, respectively; and (3) a screw cooperating with each of said bush members for fastening said cover member to said shell member while permitting pivotal movement of said visor member about the smaller step portion.

* * * * *